United States Patent [19]

Santo

[11] Patent Number: 4,615,060

[45] Date of Patent: Oct. 7, 1986

[54] CORNER CHAMBERS FOR A FLOATATION SLEEP SYSTEM

[76] Inventor: Phillip J. Santo, 12 Mountain Rd., Rochester, N.Y. 14625

[21] Appl. No.: 730,273

[22] Filed: May 3, 1985

[51] Int. Cl.[4] ..... A47C 27/10

[52] U.S. Cl. ..... 5/451; 5/452

[58] Field of Search ..... 5/451, 452, 455, 450, 5/457, 458, 422, 441

[56] References Cited

U.S. PATENT DOCUMENTS

| | | | |
|---|---|---|---|
| 3,778,852 | 12/1973 | Penn et al. | 5/452 |
| 3,918,110 | 11/1975 | Cantillo et al. | 5/452 |
| 3,925,835 | 12/1975 | Pennington et al. | 5/452 |
| 4,055,867 | 11/1977 | Phillips | 5/452 |
| 4,245,364 | 1/1981 | Calleance | 5/452 |
| 4,501,036 | 2/1985 | Santo | 5/451 |

*Primary Examiner*—Alexander Grosz

*Attorney, Agent, or Firm*—Lawrence P. Kessler

[57] ABSTRACT

A floatation sleep system of a construction which facilitates attaching and retaining bedclothes thereto. The floatation sleep system includes a flexible bladder having opposed substantially planar rectangular surfaces and marginal perimeter surfaces interconnecting the opposed surfaces to form a chamber adapted to contain a fluid. The corners of the bladder chamber have, for example, respective chambers adapted to contain a relatively non-compressible medium for preventing fluid from entering such corners. The corners thus maintain their shape irrespective of movement of fluid within the bladder.

7 Claims, 4 Drawing Figures

CORNER CHAMBERS FOR A FLOATATION SLEEP SYSTEM

BACKGROUND OF INVENTION

This invention relates generally to floatation sleep systems, and more particularly to chambers located in the corners of a floatation sleep system to facilitate attaching and holding bedclothes thereto.

Floatation sleep systems, commonly referred to as waterbeds, have become a popular alternative to conventional bedding. A primary reason for such popularity is that floatation sleep systems provide totally balanced body support which has been found to induce a superior state of relaxation. One of the most common types of floatation sleep systems includes a flexible bladder filled with liquid, such as water for example. The bladder is supported on a platform and has an upstanding frame located about the lateral marginal edges of the bladder. The frame, which may be of rigid or compressible material, supports such edges to maintain the overall height of the bladder and prevent the bottoming out of the bladder when a body rests on the body-supporting surface of the bladder. Typically, the bladder is covered with conventional bedclothes such as sheets or blankets, for example. However, it is difficult to attach or retain the bedclothes on the bladder. This is primarily due to the fact that movement of the fluid within the bladder alters the shape of the bladder at the perimeter where attachment takes place. For example, when lifting a corner of the bladder to attach a sheet thereto, the fluid leaves such corner and the corner collapses.

SUMMARY OF THE INVENTION

This invention is directed to a floatation sleep system of a construction which facilitates attaching and retaining bedclothes thereto. The floatation sleep system includes a flexible bladder having opposed substantially planar rectangular surfaces and marginal perimeter surfaces interconnecting the opposed surfaces to form a chamber adapted to contain a fluid. The corners of the bladder chamber have, for example, respective chambers adapted to contain a relatively non-compressible medium for preventing fluid from entering such corners. The corners thus maintain their shape irrespective of movement of fluid within the bladder.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
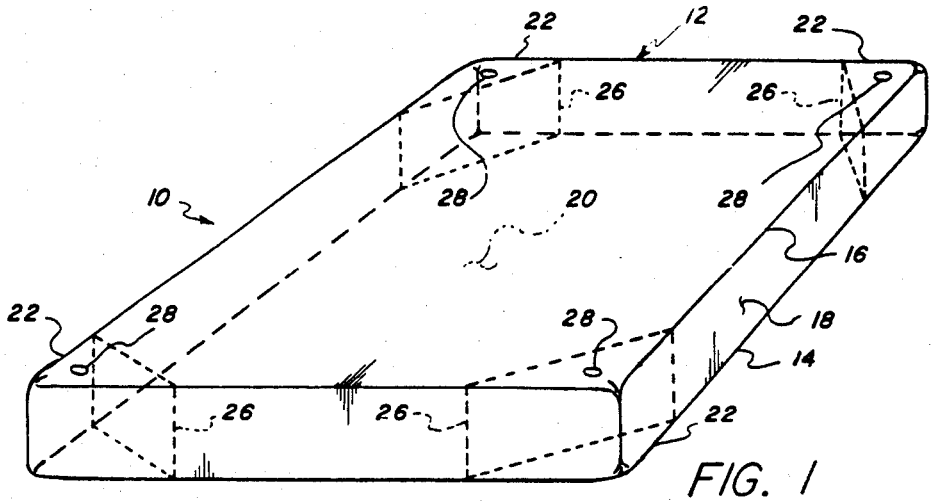
FIG. 1 is a view, in perspective, of a floatation sleep system flexible bladder with corner chambers according to this invention.

Referring now to the accompanying drawings, FIG. 1 shows a floatation sleep system, designated generally by the numeral 10. The sleep system 10 comprises a bladder 12 formed of a flexible, dimensionally stable, fluid impervious material, such as polyethylene for example. The bladder has a substantially rectangular lower surface 14 and an opposed substantially rectangular upper surface 16. The opposed surfaces are interconnected by a marginal perimeter surface 18. Such opposed lower and upper surfaces and marginal perimeter surface define an internal chamber 20 adapted to contain a fluid, such as water for example.

Figure 2:
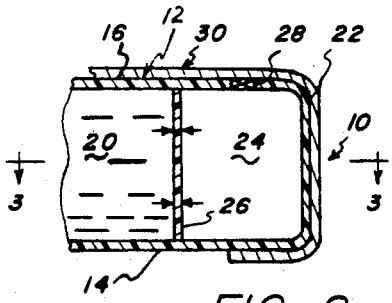
FIG. 2 is a side elevational view, in cross-section, of one corner construction for the flexible bladder of FIG. 1.
Figure 3:
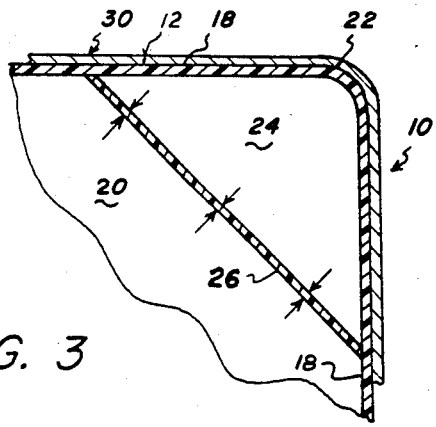
FIG. 3 is a plan view, in cross-section of the corner construction for the flexible bladder, taken along lines 3—3 of FIG. 2.

The corners 22 of the bladder 12 have chambers 24 formed therein. As shown in FIGS. 2 and 3, chambers 24 are respectively formed by a flexible, dimensionally stable, fluid impervious material sheet 26 attached to the lower surface 14, upper surface 16 and adjacent portions of the marginal perimeter surface 18. The attachment of the sheet 26 is accomplished by heat sealing, for example, in order to fluidically separate the chambers 24 from the internal bladder chamber 20. The chambers 24 are adapted to be filled with a medium which is relatively non-compressible when compared to the fluid in the bladder chamber 20. Such medium is for example compressed air fed to the chambers 24 through appropriate respective valves 28.

When the chambers 24 are filled with such relatively non-compressible medium, the medium will act on sheets 26 to counterbalance fluid pressure on the opposite sides thereof and prevent fluid in the bladder chamber from entering the corners. The corners 22 will thus always retain their shape. This is true even, for example, when the corners are lifted to attach bedclothes 30 to bladder 12. As discussed above, prior bladders tend to collapse in the corners when the corners are lifted due to fluid moving out of such corners as they are lifted. Further, the ability to retain the corner shape serves to retain the bedclothes on the bladder even when the fluid within the bladder chamber moves due to movement of a body supported on the bladder. Accordingly, bedclothes are readily attached to the bladder and are retained thereon during normal use.

Figure 4:
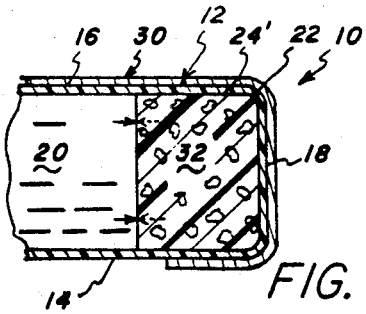
FIG. 4 is a side elevational view similar to FIG. 2, in cross-section, of an alternate corner construction for the flexible bladder.

FIG. 4 shows an alternate embodiment of chambers 24' respectively located in the corners 22 of the bladder 12. The chambers 24' contain a solid material 32, such as closed-cell foam for example, selected to be relatively non-compressible when compared to the fluid in the bladder chamber 20. The material 32 is permanently securred in the respective corners 22 by any appropriate mechanism such as gluing for example. Alternatively, the chambers 24' may be formed by respective sheets similar to sheets 26, with the material 32 being freely retained in the corners 22 by such sheets and the lower, upper, and perimeter surfaces. Additionally, a selectively sealable opening may be provided in any one of such surfaces, at such corners, to enable ready insertion or replacement of the material 32. These chambers 24' function in the same manner as described above for chambers 24 to retain the corner shape of the bladder 12 to facilitate attachment and retention of bedclothes on the bladder.

The invention has been described in detail with particular reference to preferred embodiments thereof, but it will be understood that variations and modifications can be effected within the spirit and scope of the invention.

I claim:

1. Floatation sleep system of a construction which facilitates applying of bedclothes thereto, said floatation sleep system comprising:

a flexible bladder having opposed substantially planar rectangular surfaces and marginal perimeter surfaces interconnecting said opposed surfaces to form a chamber adapted to contain a fluid; and a plurality of chambers located in the corners of said bladder chamber, said plurality of chambers respectively including a flexible, fluid impervious member connected to and extending between said opposed rectangular surfaces and connected to and extending between adjacent marginal perimeter surfaces, whereby said corner chambers are adapted to contain a relatively non-compressible medium for preventing fluid from entering the corners of said bladder chamber.

2. The invention of claim 1 wherein said non-compressible medium includes a plurality of closed-cell foam members respectively located in said corner chambers.

3. Floatation sleep system comprising:

a flexible bladder having opposed substantially planar rectangular surfaces and marginal perimeter surfaces interconnecting said opposed surfaces to form a chamber adapted to contain a fluid;

a plurality of flexible, fluid impervious members respectively connected to and extending between adjacent marginal perimeter surfaces to form chambers in the corners of said bladder chamber; and means, located in said corner chambers, for preventing fluid in said bladder chamber from filling the corners thereof, whereby the structural shape of such corners is maintained to facilitate applying and holding bedclothes to said bladder.

4. The invention of claim 3 wherein said means in said corner chambers is a relatively non-compressible medium.

5. The invention of claim 4 wherein said relatively non-compressible medium is air.

6. The invention of claim 4 wherein said relatively non-compressible medium is a closed-cell foam.

7. The invention of claim 4 wherein said flexible bladder includes selectively sealable openings, located to communicate with said corner chambers to enable said closed-cell foam to be inserted in said corner chambers.

* * * * *